US010458067B2

(12) United States Patent
Zawadzki et al.

(10) Patent No.: US 10,458,067 B2
(45) Date of Patent: Oct. 29, 2019

(54) HIGH BULK TISSUE COMPRISING CROSS-LINKED FIBERS

(71) Applicant: Kimberly-Clark Worldwide, Inc., Neenah, WI (US)

(72) Inventors: Michael Andrew Zawadzki, Appleton, WI (US); Mike Thomas Goulet, Neenah, WI (US); Donald Eugene Waldroup, Roswell, GA (US); Cathleen Mae Uttecht, Menasha, WI (US); Stephen Michael Lindsay, Appleton, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 16/332,073

(22) PCT Filed: Jan. 25, 2018

(86) PCT No.: PCT/US2018/015203

§ 371 (c)(1),
(2) Date: Mar. 11, 2019

(87) PCT Pub. No.: WO2018/144309

PCT Pub. Date: Aug. 9, 2018

(65) Prior Publication Data

US 2019/0226147 A1 Jul. 25, 2019

Related U.S. Application Data

(60) Provisional application No. 62/452,417, filed on Jan. 31, 2017.

(51) Int. Cl.

| | |
|---|---|
| ***D21H 11/20*** | (2006.01) |
| ***D21C 9/08*** | (2006.01) |
| ***D06M 15/59*** | (2006.01) |
| ***D06M 15/61*** | (2006.01) |
| ***D21H 17/55*** | (2006.01) |
| ***B31F 1/12*** | (2006.01) |
| ***D21C 9/00*** | (2006.01) |
| ***D21F 11/00*** | (2006.01) |
| ***D21H 27/00*** | (2006.01) |
| ***D21H 21/20*** | (2006.01) |
| ***D21F 1/00*** | (2006.01) |
| ***D21H 15/10*** | (2006.01) |
| ***D21F 5/18*** | (2006.01) |

(52) U.S. Cl.

CPC ..... *D21H 11/20* (2013.01); *B31F 1/126* (2013.01); *D06M 15/59* (2013.01); *D06M 15/61* (2013.01); *D21C 9/005* (2013.01); *D21C 9/08* (2013.01); *D21F 1/0027* (2013.01); *D21F 5/181* (2013.01); *D21F 11/006* (2013.01); *D21H 15/10* (2013.01); *D21H 17/55* (2013.01); *D21H 21/20* (2013.01); *D21H 27/002* (2013.01); *D21H 27/005* (2013.01)

(58) Field of Classification Search

CPC ..... D21H 11/20; D21H 21/20; D21H 17/55; D21H 17/52; D21H 17/56; D21H 27/002; D21H 27/30; D06M 2101/06; D06M 15/59; D06M 15/61; D21C 9/005; D21C 9/002; D21C 9/08; D21F 11/006; D21F 1/0027; D21F 5/181; B31F 1/126; B32B 29/00

See application file for complete search history.

(56) References Cited

U.S. PATENT DOCUMENTS

| | | | | |
|---|---|---|---|---|
| 3,657,066 A | | 4/1972 | Chene et al. | |
| 3,817,825 A | | 6/1974 | Maranville et al. | |
| 3,880,707 A | | 4/1975 | Pattison | |
| 3,880,709 A | | 4/1975 | Pattison | |
| 3,932,209 A | | 1/1976 | Chatterjee | |
| 3,988,198 A | | 10/1976 | Wilson et al. | |
| 4,162,359 A | | 7/1979 | Leithem et al. | |
| 4,181,567 A | | 1/1980 | Riddell et al. | |
| 4,399,275 A | | 8/1983 | Sears | |
| 4,416,727 A | | 11/1983 | Elton et al. | |
| 4,583,984 A | | 4/1986 | Turunen et al. | |
| 4,889,595 A | * | 12/1989 | Herron | D06M 13/127 162/157.6 |
| 5,225,047 A | | 7/1993 | Graef et al. | |
| 5,755,828 A | * | 5/1998 | Westland | D06M 13/192 162/146 |

(Continued)

FOREIGN PATENT DOCUMENTS

| | | | | |
|---|---|---|---|---|
| EP | 8536 B1 | | 8/1984 | |
| EP | 0251674 A2 | * | 1/1988 | D06M 13/12 |

(Continued)

OTHER PUBLICATIONS

Diack, A., Solenis: World-class Wet Strength Resins for Tissue and Towel. Perini Journal, Sep. 30, 2014, vol. 43.

*Primary Examiner* — Jose A Fortuna
(74) *Attorney, Agent, or Firm* — Kimberly-Clark Worldwide, Inc.

(57) ABSTRACT

The present application relates to a cross-linked fiber and more specifically to fibers that have been subjected to cold caustic extraction (at less than 60° C.) to reduce the hemicellulose content of the fibers by at least 50% and then cross-linked with a cross-linking agent that is curable at a modest temperature, such as less than 160° C. The treated cross-linked fibers preferably have a hemicellulose content that is less than 5% by weight of the fiber. Preferable cross-linking agents are polyamide-epichlorohydrin (PAE) resins, polyamide-polyamine-epichlorohydrin (PPE) resins, and polydiallylamine-epichlorohydrin resins. The cross-linked fibers are readily dispersible in water even without fiberization and generally form webs and products having relatively few knits or knots. As such, the cross-linked fibers of the present invention are well suited for use in the manufacture of tissue webs and products, particularly wet-laid tissue webs and products.

20 Claims, No Drawings

(56) References Cited

U.S. PATENT DOCUMENTS

| | | | | |
|---|---|---|---|---|
| 6,361,651 | B1 | 3/2002 | Sun | |
| 6,419,787 | B2 | 7/2002 | Goulet et al. | |
| 6,531,593 | B1 * | 3/2003 | Luo | C08B 3/00 536/30 |
| 6,620,293 | B2 | 9/2003 | Sears et al. | |
| 7,195,695 | B2 | 3/2007 | Sears et al. | |
| 7,288,167 | B2 | 10/2007 | Sears et al. | |
| 7,320,740 | B2 | 1/2008 | Hamed et al. | |
| 7,812,153 | B2 | 10/2010 | Svenson et al. | |
| 8,247,641 | B2 | 8/2012 | Leithem et al. | |
| 8,500,956 | B2 | 8/2013 | Sixta et al. | |
| 8,734,612 | B2 | 5/2014 | Leite | |
| 2003/0070776 | A1 | 4/2003 | Crow et al. | |
| 2003/0203195 | A1 * | 10/2003 | Marsh | B32B 29/00 428/357 |
| 2004/0177935 | A1 | 9/2004 | Hamed et al. | |
| 2004/0256065 | A1 | 12/2004 | Ahmed et al. | |
| 2005/0072542 | A1 | 4/2005 | Sears et al. | |
| 2006/0144541 | A1 | 7/2006 | Nickel et al. | |
| 2007/0254550 | A1 | 11/2007 | Hamed et al. | |
| 2010/0021975 | A1 | 1/2010 | Sixta et al. | |
| 2013/0029106 | A1 | 1/2013 | Lee et al. | |
| 2013/0149614 | A1 | 6/2013 | Kubo et al. | |
| 2014/0105691 | A1 | 4/2014 | Friederichs et al. | |
| 2015/0041087 | A1 | 2/2015 | Hawkins et al. | |
| 2015/0259859 | A1 * | 9/2015 | Ringold | D21H 17/52 162/164.6 |
| 2019/0226147 | A1 * | 7/2019 | Zawadzki | D21H 27/002 |

FOREIGN PATENT DOCUMENTS

| | | | | |
|---|---|---|---|---|
| EP | 0252649 | A2 * | 1/1988 | D06M 13/127 |
| EP | 700473 | A1 | 3/1996 | |
| WO | 9509273 | A1 | 4/1995 | |
| WO | 9743483 | A1 | 11/1997 | |
| WO | WO-9813545 | A1 * | 4/1998 | C08B 15/10 |
| WO | WO-9827262 | A1 * | 6/1998 | D06M 13/192 |
| WO | WO-9830387 | A1 * | 7/1998 | C08B 15/10 |
| WO | 02084024 | A1 | 10/2002 | |
| WO | WO-2005035871 | A2 * | 4/2005 | D21C 9/002 |
| WO | 11051562 | A1 | 5/2011 | |
| WO | WO-2018144309 | A1 * | 8/2018 | D21H 27/002 |

* cited by examiner

HIGH BULK TISSUE COMPRISING CROSS-LINKED FIBERS

BACKGROUND OF THE DISCLOSURE

Today there is an ever increasing demand for soft, bulky tissue products, which also have sufficient tensile strength to withstand use. Traditionally the tissue maker has solved the problem of increasing sheet bulk without compromising strength and softness by adopting tissue making processes that only minimally compress the tissue web during manufacture, such as through-air drying. Although such techniques have improved sheet bulk, they have their limitations. For example, to obtain satisfactory softness the through-air dried tissue webs often need to be calendered, which may negate much of the bulk obtained by through-air drying.

Tissue product bulk may also be increased by treating a portion of the papermaking furnish with chemicals that facilitate the formation of covalent bonds between adjacent cellulose molecules. This process, commonly referred to as cross-linking, often involves the treatment of water soluble multi-functional molecules capable of reacting with cellulose under mildly acidic conditions. The cross-linking agents are generally methylol or alkoxymethyl derivatives of different N-containing compounds such as urea and cyclic ureas. Polycarboxylic acids and citric acid have also been used with varying degrees of success. Sheets formed from cross-linked cellulosic fibers, while having increased bulk, generally have poor tensile and tear strength, because of reduced fiber to fiber bonding.

To lessen the negative effects of cross-linked fibers the prior art has resorted to alternative cross-linking agents and to blending cross-linked and uncross-linked fibers together. For example, in U.S. Pat. No. 3,434,918 sheeted fiber is treated with a cross-linking agent and catalyst and wet aged to insolubilize the cross-linking agent. The fiber sheet is then dispersed and blended with non-cross-linked fibers to form a fiber slurry used to form a creped tissue web, which is subsequently passed under a dryer to cure the cross-linking-agent. In U.S. Pat. No. 3,455,778 bleached southern softwood kraft pulp is reacted with dimethylol urea to form cross-linked fibers, which are blended with untreated hardwood and softwood pulps. The blended pulps were used to form a creped tissue web having improved absorbent properties. In U.S. Pat. No. 4,204,054 wood pulp fibers were sprayed with a solution of formaldehyde, formic acid and hydrochloric acid and then immediately dispersed in a hot air stream for 1-20 seconds to form cross-linked fibers. The cross-linked fibers were then blended with uncross-linked fibers to form a sheet having improved flexibility and water absorbency. Finally, in U.S. Pat. No. 6,837,972 cross-linked cellulosic fibers are blended with softwood kraft pulps having an elevated hemicellulose content to form tissue webs. The tissue webs, while having increased bulk, have greatly diminished tensile strength.

Accordingly, what is needed in the art is a tissue product comprising cross-linked fibers that is both bulky and strong without any decrease in softness.

SUMMARY OF THE DISCLOSURE

It has now been surprisingly discovered that the sheet bulk of a tissue web may be increased, with little or no degradation in tensile strength and without stiffening the web, by forming a tissue web comprising cross-linked fibers and more specifically cold caustic extracted cellulosic fibers reacted with a cross-linking agent curable at relatively low temperatures, such as less than about 200° C. and more preferably less than about 180° C. and still more preferably less than about 160° C. The cross-linked fibers may be incorporated into tissue webs and products that not only have good bulk and strength, but which have relatively low levels of knits and knots, such as webs having less than about 12 percent knits per gram of web.

Accordingly, in one embodiment the present disclosure provides a method of manufacturing a cross-linked fiber comprising the steps of: (a) providing a plurality of fibers having a first hemicellulose content, (b) treating a plurality of fibers with a caustic solution at a temperature less than about 60° C. to yield a plurality of caustic extracted fibers having a second hemicellulose content which is at least about 50 percent less than the first hemicellulose content (c) mixing the caustic extracted fibers with a cross-linking agent to yield a plurality of treated fibers, and (d) drying the treated fibers at a drying temperature less than about 200° C. to yield a plurality of cross-linked fibers. In certain embodiments the cross-linking agent is a polyamide epichlorohydrin (PAE) resin and is mixed with the caustic treated fibers at add-ons from about 3 to about 20 kg per metric ton (MT) of fiber and more preferably from about 5 to about 15 kg/MT of fiber.

In other embodiments the present invention provides a water dispersible cellulosic cross-linked fiber comprising less than about 5.0 percent hemicellulose, a cross-linking agent selected from the group consisting of polyamide-epichlorohydrin (PAE) resins, polyamide-polyamine-epichlorohydrin (PPE) resins, and polydiallylamine-epichlorohydrin resins, wherein the water dispersible cellulosic cross-linked fiber has a water retention value (WRV) less than about 0.80 g/g.

In other embodiments the present invention provides a method of making a high bulk tissue product comprising the steps of: (a) dispersing cross-linked fibers in water to form an aqueous suspension of cross-linked fibers having a water retention value (WRV) less than about 0.80 g/g; (b) depositing the aqueous suspension of cross-linked fibers on a forming fabric to form a wet tissue web (c) partially dewatering the wet tissue web and (d) drying the partially dewatered tissue web to a consistency of at least about 95 percent to form a tissue web; and (e) converting the tissue web to form a tissue product, wherein the tissue product has a basis weight from about 10 to about 50 gsm and a sheet bulk of about 5 cc/g or greater. In a particularly preferred embodiment the foregoing tissue product comprises less than about 15 percent knits per gram of sheet material and still more preferably less than about 12 percent knits per gram of sheet material.

In still other embodiments the present invention provides a tissue product comprising cross-linked cellulosic fibers, such as from about 5 to about 75 percent, and more preferably from about 20 to about 60 percent and still more preferably from about 20 to about 50 percent, cross-linked cellulosic fibers by weight of the product, where the sheet bulk of the product is at least about 10 percent greater than the sheet bulk of comparable tissue product, such as a tissue product having substantially equal strength and basis weight, that is substantially free from cross-linked fibers.

In yet other embodiments the present invention provides a single-ply through-air dried tissue product comprising from about 5 to about 75 percent, and more preferably from about 20 to about 60 percent and still more preferably from about 20 to about 50 percent, by weight of the tissue product, cross-linked fibers, wherein the product has a basis weight from about 20 to about 50 gsm, a GMT from about 600 to about 1,000 g/3", a sheet bulk greater than about 10 cc/g, such as from about 10 to about 25 cc/g, and a Stiffness Index less than about 15.

Other features and aspects of the present invention are discussed in greater detail below.

DEFINITIONS

As used herein the term "cross-linked fiber" refers to any cellulosic fibrous material subject to caustic extraction, mixed with a cross-linking agent and cured to form a treated fiber. Preferably caustic extraction reduces the hemicellulose content of the fiber by at least about 50 percent. In certain embodiments the cross-linked fiber may have a hemicellulose content, measured as the average percent solubility, as described in the test methods section below, less than about 5.0 percent and more preferably less than about 4.0 percent and still more preferably less than about 3.0 percent, such as from about 0.5 to about 5.0 percent.

As used herein, the term "tissue product" refers to products made from tissue webs and includes, bath tissues, facial tissues, paper towels, industrial wipers, foodservice wipers, napkins, medical pads, and other similar products. Tissue products may comprise one, two, three or more plies.

As used herein, the terms "tissue web" and "tissue sheet" refer to a fibrous sheet material suitable for forming a tissue product.

As used herein, the term "layer" refers to a plurality of strata of fibers, chemical treatments, or the like, within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

As used herein the term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "basis weight" generally refers to the bone dry weight per unit area of a tissue and is generally expressed as grams per square meter (gsm). Basis weight is measured using TAPPI test method T-220.

As used herein, the term "geometric mean tensile" (GMT) refers to the square root of the product of the machine direction tensile and the cross-machine direction tensile of the web, which are determined as described in the Test Method section.

As used herein, the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "sheet bulk" refers to the quotient of the caliper (μm) divided by the bone dry basis weight (gsm). The resulting sheet bulk is expressed in cubic centimeters per gram (cc/g).

As used herein, the term "slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams per 3 inch sample width or g/3".

As used herein, the term "geometric mean slope" (GM Slope) generally refers to the square root of the product of machine direction slope and cross-machine direction slope. GM Slope generally is expressed in units of kilograms or grams As used herein, the term "Stiffness Index" refers to the quotient of the geometric mean slope (having units of g/3") divided by the geometric mean tensile strength (having units of g/3").

As used herein the term "substantially free from cross-linked fiber" refers to a layer of a web that has not been formed with the addition of cross-linked fiber. Nonetheless, a layer that is substantially free of cross-linked fiber may include de minimus amounts of cross-linked fiber that arise from the inclusion of cross-linked fibers in adjacent layers.

The "Water Retention Value" (WRV) is the amount of water naturally retained by fibers, expressed as grams of water per gram of fiber (g/g). The Water Retention Value is described in U.S. Pat. No. 6,096,169, which is hereby incorporated by reference for that purpose. Cross-linking fibers according to the present invention may reduce the WRV by about 15 percent, such as from about 15 to about 35 percent, compared to fibers that have not been cross-linked. More specifically, the WRV of the instant cross-linked fibers may be less than about 0.80 g/g, such as less than about 0.75 g/g or less than about 0.70 g/g. The WRV for a papermaking furnish consisting of more than one type of fiber is the weighted average of the WRV for the individual fiber type components. By way of example, if the furnish consists of 50 percent fiber component A having a WRV of 1.33 g/g and 50 percent fiber component B having a WRV of 1.41 g/g, the furnish WRV is 0.5 (1.33)+0.5 (1.41)=1.37 g/g.

As used herein, the terms "TS750" and "TS750 value" refer to the output of the EMTEC Tissue Softness Analyzer (commercially available from Emtec Electronic GmbH, Leipzig, Germany) as described in the Test Methods section. TS750 has units of dB $V^2$ rms, however, TS750 may be referred to herein without reference to units.

In the interests of brevity and conciseness, any ranges of values set forth herein contemplate all values within the range and are to be construed as written description support for claims reciting any sub-ranges having endpoints which are whole number or otherwise of like numerical values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5. In addition, any values prefaced by the word "about" are to be construed as written description support for the value itself. By way of example, a range of "from about 1 to about 5" is to be interpreted as also disclosing and providing support for a range of "from 1 to 5", "from 1 to about 5" and "from about 1 to 5."

DETAILED DESCRIPTION OF THE DISCLOSURE

The present invention generally relates to a cross-linked fiber and more specifically to fibers that have been subjected to caustic extraction, particularly cold caustic extraction, to reduce the hemicellulose content of the fibers by at least about 50 percent and then cross-linked with a cross-linking agent that is curable at a low temperature, such as less than about 200° C. and more preferably less than about 180° C. and still more preferably less than about 160° C., such as from about 100 to about 200° C. The resulting cross-linked fibers are readily dispersible in water, even without fiberization. The water dispersible cross-linked fibers are well suited for forming wet laid tissue products and may yield tissue webs and products having relatively few knits or knots. As such, the cross-linked fibers of the present invention are well suited for use in the manufacture of tissue webs and products and particularly wet-laid tissue webs and products.

Accordingly, in certain embodiments the present invention provides wet-laid tissue products comprising the inventive cross-linked fiber where the tissue products have improved physical properties such as increased bulk, reduced stiffness and improved compressive resistance compared to similarly manufactured tissue products that are substantially free from cross-linked fiber. For example, tissue products may have a sheet bulk that is at least about 10 percent and more preferably at least about 15 percent and still more preferably at least about 20 percent greater than similarly manufactured tissue products that are substantially free from cross-linked fiber.

In other embodiments the tissue products prepared according to the present invention may have comparable basis weights, tensile strengths and reduced stiffness, such that the Stiffness Index may be reduced by about 10 percent, more preferably about 15 percent, and still more preferably about 20 percent, compared to similarly manufactured tissue products that are substantially free from cross-linked fiber.

Tissue products and webs according to the present invention are generally prepared from a fiber furnish comprising a water dispersible cross-linked cellulosic fiber that has been subject to treatment with a caustic to remove a portion of the fiber's hemicellulose such that the extracted fiber comprises less than about 5.0 percent, by weight of the fiber, hemicellulose. Cellulosic fibers suitable for cross-linking may include wood pulp fibers, which may be formed by a variety of pulping processes, such as kraft pulp, sulfite pulp, thermomechanical pulp, and the like. Further, the wood fibers may be any high-average fiber length wood pulp, low-average fiber length wood pulp, or mixtures of the same. One example of suitable high-average length wood pulp fibers include softwood fibers such as, but not limited to, northern softwood, southern softwood, redwood, red cedar, hemlock, pine (e.g., southern pines), spruce (e.g., black spruce), combinations thereof, and the like. One example of suitable low-average length wood pulp fibers include hardwood fibers, such as, but not limited to, *eucalyptus*, maple, birch, aspen pulp fibers. In certain instances, *eucalyptus* pulp fibers may be particularly desired to increase the softness of the web. Moreover, if desired, secondary fibers obtained from recycled materials such as, newsprint, reclaimed paperboard, and office waste, may be used.

In the course of preparing cross-linked fibers, the cellulosic fibers are treated with a caustic solution to extract a portion of the hemicellulose. Preferably treatment with a caustic solution is carried out in non-mercerizing conditions so as to remove only a portion of the hemicellulose. Particularly preferred is treatment of fibers with a caustic solution at temperatures less than about 60° C., a process commonly referred to as cold caustic extraction (CCE) or cold alkali extraction (CAE). Suitable methods of fiber treatment are described in U.S. Pat. No. 7,919,667, the contents of which are incorporated herein by reference in a manner consistent with the present disclosure.

Preferably the caustic treatment is carried out at less than about 60° C., more preferably less than 50° C. and still more preferably less than about 40° C., such as from about 10 to 40° C. The caustic agent may be selected from the group consisting of sodium hydroxide, potassium hydroxide and ammonium hydroxide, and combinations thereof. In other embodiments the caustic may be the white liquor (NaOH and $NaS_2$) from a kraft pulping process. The concentration of caustic may range from about 3.0 to about 25 percent, more preferably from about 6.0 to about 20 percent and more preferably from about 10 to about 15 percent. The fiber consistency may range from about 2.0 to about 25 percent, such as from about 5.0 to about 20 percent and more preferably from about 8.0 to about 12 percent during the caustic treatment.

Regardless of the method of extraction, the caustic extracted fiber generally has a reduced hemicellulose content. For example, cold caustic extraction may reduce the hemicellulose content by at least about 50 percent, more preferably at least about 55 percent and still more preferably at least about 60 percent, such as a hemicellulose reduction from about 50 to about 75 percent. For example, in one embodiment the fiber to be treated may be a *eucalyptus* hardwood kraft pulp fiber having a hemicellulose content of about 5.0 percent, by weight, which upon cold caustic extraction is reduced to less than about 2.5 percent, such as from about 2.0 to about 2.5 percent, by weight. Without being bound by any particularly theory it is believed that reducing the hemicellulose content by at least about 50 percent, provides a porous fiber surface when the extracted pulps are treated with a cross-linking agent, and fiber-to-fiber bridging of cross-linking agent is reduced. Cold caustic extraction also reduces the density of the fiber network, which further reduces fiber-to-fiber bridging. Reduction in the degree of fiber-to-fiber bridging of the cross-linking agent during drying further results in fewer knits or knots, improves dispensability of the pulp in water and enables the formation of tissue products having improved properties.

After caustic extraction, the cellulosic fiber is treated with a cross-linking agent, such as by mixing a cross-linking agent with the caustic extracted fiber. Preferably treatment of the caustic extracted fiber with a cross-linking agent occurs at relatively low fiber consistencies, such as less than about 15 percent and more preferably less than about 10 percent and still more preferably less than about 5.0 percent, such as from about 1.0 to about 15 percent and more preferably from about 1.5 to about 5.0 percent. In certain embodiments the fiber may be subjected to caustic treatment at a first consistency and then partially dewatered prior to treatment with the cross-linking agent. For example, the caustic extraction may be carried out at a fiber consistency greater than about 10 percent and treatment with the cross-linking agent may be carried out at a fiber consistency less than about 10 percent.

After treatment with a cross-linking agent the treated fiber is dewatered and dried to cure the cross-linking agent. Preferably drying is carried out at modest temperatures, such as less than about 200° C., more preferably less than about 160° C. and still more preferably less than about 140° C., such as from about 80 to about 200° C. and more preferably from about 100 to about 160° C. and still more preferably from about 110 to about 150° C. For example, the treated fiber may be heated by exposing the fibers to heated air or a heated surface where the temperature of the air or surface is from about 100 to about 200° C. and more preferably from about 100 to about 160° C. One skilled in the art will appreciate that when exposed to the foregoing drying temperatures the actual temperature of the sheet and therefore temperature of the cross-linking agent will be less. Generally it is preferred that the cross-linking agent be heated to less than about 160° C. and more preferably less than about 140° C., such as from about 80 to about 160° C. to cure the cross-linking and dry the treated fiber. In certain instances the treated fiber may be dried to a consistency from about 90 to about 100 percent during the curing step.

In a particularly preferred embodiment the cross-linking agent is selected from the group consisting of polyamide-epichlorohydrin (PAE) resins, polyamide-polyamine-epichlorohydrin (PPE) resins, polydiallylamine-epichlorohydrin resins and other such resins generally produced via the reaction of an amine-functional polymer with an epihalohydrin. Many of these resins are described in the text "Wet Strength Resins and Their Applications", chapter 2, pages 14-44, TAPPI Press (1994), which is incorporated herein by reference in a manner consistent with the present disclosure. Particularly preferred are PAE resins available under the trade name Kymene™ (commercially available from Solenis LLC, Wilmington, Del.).

The cross-linking agent is applied to the caustic extracted fibers in an amount sufficient to effect intrafiber cross-linking. The amount of cross-linking agent applied to the caustic extracted fibers may range from about 3 to 20 kg per metric ton (MT) of fiber and more preferably from about 5 to about 15 kg/MT of fiber.

In certain preferred embodiments the cross-linking agent is a PAE resin and treatment of the caustic extracted fiber is carried out at a consistency from about 2.0 to about 10 percent and a pH from about 5.0 to about 9.0 and more preferably from about 6.0 to about 8.0. Further, where the cross-linking agent is a PAE resin, it is generally preferred to carry out the cross-linking treatment at a temperature less than about 40° C., such as from about 10 to about 40° C.

In certain embodiments it may be preferable to refine the caustic extracted fiber prior to treatment with the cross-linking agent to enhance the amount of fiber surface area available for reaction with the cross-linking agent.

After treatment with the cross-linking agent, the treated fiber is generally heated to dry the treated fiber and cure the cross-linking agent, effectively reacting the fiber and the cross-linking agent and causing inter-fiber cross-linking. For example, the treated fiber may be exposed to elevated temperatures, such as from about 100 to about 200° C. and more preferably from about 120 to about 160° C. to cure the cross-linking agent. Curing may also dry the treated fiber to a consistency from about 90 to about 100 percent thereby yielding a dried cross-linked fiber according to the present invention.

Where the cross-linking agent is a PAE resin, it may be preferable to cure the treated fiber at a relatively low temperature, such as less than about 160° C. and more preferably less than about 140° C., such as from about 100 to about 120° C. It will be appreciated that although the PAE resin may be cured at relatively low temperatures, the rate of curing can be accelerated at higher temperatures associated with curing conventional cross-linking agents. However, such higher cure temperatures are not necessary when using PAE as the cross-linking agent.

In one embodiment cross-linking may be carried out by dispersing caustic extracted fibers, such as caustic extracted *eucalyptus* hardwood kraft pulp fibers having a hemicellulose content from about 2.0 to about 2.5 percent, in water to form a caustic extracted fiber slurry having a consistency from about 0.5 to about 5.0 percent. The pH and temperature of the slurry may be adjusted to about 6.0 to about 8.0 and from about 10 to about 40° C. A PAE resin is then added to the caustic extracted fiber slurry at an add-on level of about 5 to about 15 kg of PAE per metric ton (MT) of caustic extracted fiber. The PAE resin is allowed to interact with the fiber, preferably with mixing, to yield a treated fiber. In certain embodiments the treated fiber may be partially dewatered and then subjected to one or more stages of drying, where each drying stage is carried out at a temperature from about 100 to about 160° C. to yield a dry cross-linked fiber having a consistency from about 90 to about 100 percent.

In certain embodiments the cross-linked fibers of the present invention can be characterized as having a reduced water retention value (WRV) relative to comparable uncross-linked fibers. For example, cross-linking fibers according to the present invention may reduce the WRV by about 15 percent, compared to uncross-linked fibers, such as from about 15 to about 35 percent. In certain embodiments, the present invention provides cross-linked fibers having a WRV less than about 0.80 grams of water per gram of fiber, more preferably less than about 0.75 g/g and still more preferably less than about 0.70 g/g. Fibers having lower WRV's, dewater easier than others, which may increase the efficiency of the tissue manufacture process when using the instant cross-linked fibers as one component of the fiber furnish.

In addition to having reduced WRV, the inventive cross-linked fibers may also be readily dispersible in water and capable of forming wet-laid tissue webs having relatively few knits or knots. Often cross-linking of cellulosic fibers results in knits or knots resulting in poor performance when the fibers are wet-laid. Thus, it was unexpected to find that reducing the hemicellulose content by cold caustic extraction resulted in a cross-linked fiber that could be readily dispersed in water to form a wet-laid tissue web having few knits or knots, particularly compared to cross-linked pulps prepared without cold caustic extraction. For example, the inventive cross-linked fiber may form a wet laid tissue web comprising less than about 15 percent knits per gram of sheet material and still more preferably less than about 12 percent knits per gram of sheet material.

Another advantage of the instant cross-linked fibers is that they may be incorporated into wet-laid tissue products to improve bulk characteristics. For example, the cross-linked fibers may be used in the manufacture of wet laid tissue products where the resulting tissue products have a sheet bulk that is at least about 10 percent, and more preferably at least about 15 percent, greater than the sheet bulb of a comparable tissue product, such as a tissue product having substantially equal strength and basis weight, that is substantially free from cross-linked fibers.

As the instant cross-linked fibers are readily dispersible in water and form sheets having few knits or knots they are well suited to manufacturing tissue webs and products using a wide range of known techniques, such as, adhesive creping, wet creping, double creping, wet-pressing, air pressing, through-air drying, creped through-air drying, uncreped through-air drying, as well as other steps in forming the paper web. In a particularly preferred embodiment the cross-linked fibers of the present invention are used in the manufacture of tissue webs by non-compressive dewatering and drying methods, such as through-air drying. Through-air dried tissue webs may be either creped or uncreped. Examples of suitable tissue manufacturing methods are disclosed in U.S. Pat. Nos. 5,048,589, 5,399,412, 5,129,988 and 5,494,554, all of which are incorporated herein in a manner consistent with the present disclosure. When forming multi-ply tissue products, the separate plies can be made from the same process or from different processes as desired.

Generally the cross-linked fibers are incorporated in tissue webs and products in an amount sufficient to alter at least one physical property of the web or product, such as sheet bulk, tensile, stiffness, or the like. As such, the resulting tissue webs and products may comprise from about 5 to about 75 percent, preferably from about 10 to about 60 percent, more preferably from about 20 to about 50 percent, and still more preferably from about 25 to about 45 percent, cross-linked cellulosic fibers.

To form tissue webs and products, cross-linked cellulosic fibers are generally combined with conventional non-cross-linked fibers to form a homogenous tissue web, or incorporated into one or more layers of a layered tissue web. The non-cross linked fibers may generally comprise any conventional papermaking fiber, which are well known in the art. For example, non-cross-linked fibers may comprise wood pulp fibers formed by a variety of pulping processes, such as kraft pulp, sulfite pulp, thermomechanical pulp, etc. Further, the wood pulp fibers may comprise high-average fiber length wood pulp fibers or low-average fiber length wood pulp fibers, as well as mixtures of the same. One example of suitable high-average length wood pulp fibers include softwood fibers such as, but not limited to, northern softwood, southern softwood, redwood, red cedar, hemlock, pine (e.g., southern pines), spruce (e.g., black spruce), combinations thereof, and the like. One example of suitable low-average length wood pulp fibers include hardwood fibers, such as, but not limited to, *eucalyptus*, maple, birch, aspen, and the like, which can also be used. Moreover, if desired, secondary fibers obtained from recycled materials may be used, such as fiber pulp from sources such as, for example, newsprint, reclaimed paperboard, and office waste.

The non-cross-linked fibers are generally combined with cross-linked fibers, such as by blending or layering, to produce the inventive tissue webs and products. In one embodiment the fibers are arranged in layers such that the tissue web has a first layer comprising cross-linked hardwood kraft fibers and a second layer comprising softwood kraft pulp fiber, where the second layer is substantially free of cross-linked fibers. In such embodiments the cross-linked fiber may be added to the first layer, such that the first layer comprises greater than about 2 percent, by weight of the layer, cross-linked fiber, such as from about 2 to about 90 percent and more preferably from about 30 to about 70 percent.

In other embodiments the cross-linked cellulosic fibers are selectively incorporated into two layers of a three-layered tissue web and more preferably the outer layers of a three-layered tissue web. For example, the cross-linked cellulosic fibers may comprise cross-linked *eucalyptus* hardwood kraft pulp fibers (EHWK) which may be selectively incorporated in the outer layers of a three-layered tissue structure where the center layer comprises non-cross-linked cellulosic fibers, such as non-cross-linked Northern softwood kraft fiber (NSWK). In further embodiments it may be preferred that the two outer layers be substantially free from cross-linked cellulosic fiber, such as cross-linked EHWK.

Accordingly, in one embodiment the present disclosure provides a multi-layered tissue web comprising cross-linked fibers selectively disposed in one or more layers, wherein the tissue layer comprising cross-linked fibers is adjacent to a layer comprising non-cross-linked fiber and which is substantially free from non-cross-linked fiber. In a particularly preferred embodiment, the tissue product comprises at least one multi-layered web where non-cross-linked fibers are disposed in the middle layer, which is substantially free from cross-linked fiber, and the first and third layers comprise cross-linked fibers wherein the tissue product has a basis weight from about 30 to about 50 gsm, a GMT greater than about 600 g/3" and a sheet bulk greater than about 10 cc/g.

In still other embodiments the present invention provides a tissue product comprising a tissue web having three layers where the middle layer comprises cross-linked cellulosic fibers and the two outer layers are substantially free from cross-linked cellulosic fibers.

While the foregoing structures represent certain preferred embodiments it should be understood that the tissue product can include any number of plies or layers and can be made from various types of conventional unreacted cellulosic fibers and cross-linked fibers. For example, the tissue webs may be incorporated into tissue products that may be either single- or multi-ply, where one or more of the plies may be formed by a multi-layered tissue web having cross-linked fibers selectively incorporated in one of its layers.

Compared to similar tissue products prepared without cross-linked fibers, tissue products prepared according to the present disclosure are generally of comparable strength (measured as GMT) yet have significantly higher sheet bulk. Thus, in certain embodiments the present invention provides a tissue product comprising from about 5 to about 50 percent, and more preferably from about 10 to about 30 percent, by weight of the weight of the web, cross-linked fiber, wherein the product has a basis weight from about 20 to about 50 gsm, a GMT from about 600 to about 800 g/3", a sheet bulk greater than about 10 cc/g, such as from about 10 to about 25 cc/g and more preferably from about 12 to about 20 cc/g.

The basis weight of tissue webs made in accordance with the present disclosure can vary depending upon the final product. For example, the process may be used to produce bath tissues, facial tissues, and the like. In general, the basis weight of the tissue web may vary from about 10 to about 50 gsm and more preferably from about 25 to about 45 gsm. Tissue webs may be converted into single- and multi-ply bath or facial tissue products having basis weight from about 20 to about 50 gsm and more preferably from about 25 to about 45 gsm.

In certain embodiments tissue webs produced according to the present invention may be subjected to additional processing after formation such as calendering in order to convert them into tissue products. The tissue webs of the present invention are surprisingly resilient and retain a high degree of bulk compared to similar webs prepared without cross-linked fibers. The increased resiliency allows the webs to be calendered to produce a soft tissue product without a significant decrease in bulk. According, in certain embodiments the present invention provides a tissue product having a basis weight from about 20 to about 50 gsm, and more preferably from about 25 to about 45 gsm, GMT from about 600 to about 800 g/3", a sheet bulk greater than about 12 cc/g, such as from about 12 to about 20 cc/g. Further, in certain embodiments the foregoing tissue product may also have improved softness, such as a TS750 less than about 50 and more preferably less than about 47.5, such as from about 40 to about 50 and more preferably from about 42 to about 47.5.

TEST METHODS

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3 inches±0.05 inches (76.2 mm±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm*cm/cm$^2$. Slope is recorded in units of kg. Both TEA and Slope are directionally dependent and thus MD and CD directions are measured independently. Geometric mean TEA and geometric mean slope are defined as the square root of the product of the representative MD and CD values for the given property.

Water Retention Value

The water retention value (WRV) of a pulp specimen is a measure of the water retained by the wet pulp specimen after centrifuging under standard conditions. WRV can be a useful tool in evaluating the performance of pulps relative to dewatering behavior on a tissue machine. One suitable method for determining the WRV of a pulp is TAPPI Useful Method 256, which provides standard values of centrifugal force, time of centrifuging, and sample preparation. Various commercial test labs are available to perform WRV testing using the TAPPI test or a modified form thereof.

Hemicellulose Content

The hemicellulose content of cellulosic fiber is measured by the 18 percent caustic solubility method (TAPPI T-235 CM-00). In this method, a weighed quantity of pulp (1.5 g) is soaked in 18 percent by weight aqueous sodium hydroxide (100 mL) for one hour. During the soak, the pulp fibers swell and the pulp's hemicellulose dissolves into the solution. The pulp is then filtered, and 10 mL of the filtrate is mixed with 10 mL of potassium dichromate and 30 mL sulfuric acid. This solution is titrated with ferrous ammonium sulfate. The percent alkali solubility is then calculated using the amounts of the various solutions and the amount of pulp.

TS750

TS750 was measured using an EMTEC Tissue Softness Analyzer ("TSA") (Emtec Electronic GmbH, Leipzig, Germany). The TSA comprises a rotor with vertical blades which rotate on the test piece applying a defined contact pressure. Contact between the vertical blades and the test piece creates vibrations, which are sensed by a vibration sensor. The sensor then transmits a signal to a PC for processing and display. The signal is displayed as a frequency spectrum. For measurement of TS7 and TS750 values the blades are pressed against the sample with a load of 100 mN and the rotational speed of the blades is two revolutions per second.

To measure TS750 a frequency analysis in the range of approximately 200 to 1000 Hz is performed with the amplitude of the peak occurring at 750 Hz being recorded as the TS750 value. The TS750 value represents the surface smoothness of the sample. A high amplitude peak correlates to a rougher surface. TS750 has units of dB V2 rms.

Test samples were prepared by cutting a circular sample having a diameter of 112.8 mm. All samples were allowed to equilibrate at TAPPI standard temperature and humidity conditions for at least 24 hours prior to completing the TSA testing. Only one ply of tissue is tested. Multi-ply samples are separated into individual plies for testing. The sample is placed in the TSA with the softer (dryer or Yankee) side of the sample facing upward. The sample is secured and the measurements are started via the PC. The PC records, processes and stores all of the data according to standard TSA protocol. The reported values are the average of five replicates, each one with a new sample.

Handsheet Manufacture

Handsheets were prepared using a Valley Ironwork lab handsheet former measuring 8.5×8.5 inches. The pulp (either cross-linked or control) was mixed with distilled water to form slurries at a ratio of 25 g of pulp (on dry basis) to 2 L of water. The pulp/water mixture was subjected to disintegration using an L&W disintegrator Type 965583 for five minutes at a speed of 2975±25 RPM. After disintegration the mixture was further diluted by adding 4 L of water. Handsheets having a basis weight of 60 gsm were formed using the wet laying handsheet former. Handsheets were couched off the screen, placed in the press with blotter sheets, and pressed at a pressure of 75 pounds per square inch for one minute, dried over a steam dryer for two minutes, and finally dried in an oven. The handsheets were cut to 7.5-inch squares and subject to testing.

EXAMPLE

Cross-linked fibers were prepared by first dispersing approximately 575 pounds of *eucalyptus* hardwood kraft (EHWK) in approximately 500 gallons of water containing 500 pounds of sodium hydroxide. The dispersed pulp was mixed for approximately 30 minutes. The pulp was then neutralized, washed and pressed using a belt press to a consistency of about 18 percent. The neutralized and partially dewatered extracted fiber was then dispersed in water to form a slurry having a consistency of about 10 percent. Kymene 920A (Solenis LLC, Wilmington, Del.) was added to the slurry at an addition level of about 13 kg per metric ton of fiber. The slurry was agitated for about 30 minutes and dewatered using a belt press to a consistency of about 20 percent. The dewatered cross-linked EHWK (XL-EHWK) fiber was flash dried to a consistency of about 97 percent in two separate passes. The exit temperature of the XL-EHWK after the second pass was about 130° C.

The flash dried XL-EWHK was used to produce tissue products utilizing a conventional wet pressed tissue-making process on a pilot scale tissue machine. Several different tissue products were formed to assess the effect of XL-EWHK on tissue properties. The tissue products comprised layered sheet structures, typically consisting of three layers.

Northern softwood kraft (NSWK) furnish was prepared by dispersing NSWK pulp in a pulper for 30 minutes at about 2 percent consistency at about 100° F. The NSWK pulp was then transferred to a dump chest and subsequently diluted with water to approximately 0.2 percent consistency. Softwood fibers were then pumped to a machine chest.

*Eucalyptus* hardwood kraft (EHWK) furnish was prepared by dispersing EWHK pulp in a pulper for 30 minutes at about 2 percent consistency at about 100° F. The EHWK pulp was then transferred to a dump chest and diluted to about 0.2 percent consistency. The EHWK pulp was then pumped to a machine chest.

Cross-linked EHWK (XL-EWHK), prepared as described above, was dispersed in a pulper for 30 minutes at about 2 percent consistency at about 100° F. The XL-EWHK was then transferred to a dump chest and diluted to about 0.2 percent consistency. The XL-EWHK was then pumped to a machine chest.

In certain instances tissue base sheets were made using a through-air dried papermaking process commonly referred to as "uncreped through-air dried" ("UCTAD") and generally described in U.S. Pat. No. 5,607,551, the contents of which are incorporated herein in a manner consistent with the present invention. Inventive base sheets were produced from a furnish comprising northern softwood kraft, *eucalyptus* kraft and XL-EWHK using a layered headbox fed by three stock chests such that the webs having three layers (two outer layers and a middle layer) were formed. The outer layers comprised 100 percent EHWK for the control and a blend of EHWK and XL-EHWK for the inventive sample. The center layer was 100 percent northern softwood kraft fiber for the control and inventive samples.

The tissue web was formed on a Voith Fabrics TissueForm V forming fabric, vacuum dewatered to approximately 25 percent consistency and then subjected to rush transfer when transferred to the transfer fabric. The web was then transferred to a through-air drying fabric. Transfer to the through-drying fabric was done using vacuum levels of greater than 10 inches of mercury at the transfer. The web was then dried to approximately 98 percent solids before winding.

The base sheet webs were converted into rolled towel products by calendering using a conventional polyurethane/steel calender comprising a 4 P&J polyurethane roll on the air side of the sheet and a standard steel roll on the fabric side. The products were calendered to a constant caliper of about 475 μm. The finished product comprised a single ply of base sheet. The finished products (Control 1 and Inventive 1) were subjected to physical testing.

TABLE 1

| Sample | Center layer (web wt %) | Outer Layers (web wt %) | Furnish WRV (g/g) | GMT (g/3") | GM Slope (g) | Stiffness Index | TS750 |
|---|---|---|---|---|---|---|---|
| Control 1 | NSWK (40%) | EHWK (60%) | 1.4 | 941 | 6108 | 6.49 | 61.76 |
| Inventive 1 | NSWK (40%) | EHWK (36%), XL-EHWK (24%) | 1.3 | 911 | 5820 | 6.39 | 47.51 |

Additional tissue products were prepared by pumping the pulp fibers from the machine chests through separate manifolds in the headbox prior to being deposited onto a felt using an inclined Fourdrinier former. The formed sheet was partially dewatered and conveyed to a pressure roll nip. The sheet was then adhered to a Yankee dryer using a creping composition. A spray boom situated underneath the Yankee dryer sprayed a creping composition at a pressure of 80 psi. In certain instances the creping composition comprised non-fibrous olefin dispersion, sold under the trade name HYPOD 8510 (commercially available from the Dow Chemical Co.). The HYPOD 8510 was delivered at a total addition of about 150 mg/m$^2$ spray coverage on the Yankee Dryer. The sheet was dried to about 98 to 99 percent consistency as it traveled on the Yankee dryer and to the creping blade. The creping blade subsequently scraped the tissue sheet and a portion of the creping composition off the Yankee dryer. The creped tissue basesheet was then wound onto a core traveling at about 50 to about 100 fpm into soft rolls for converting.

To produce the 2-ply facial tissue products, two soft rolls of the creped tissue were then rewound, calendered, and plied together so that both creped sides were on the outside of the 2-ply structure. Mechanical crimping on the edges of the structure held the plies together. The plied sheet was then slit on the edges to a standard width of approximately 8.5 inches and folded, and cut to facial tissue length. Tissue samples (Control 2 and Inventive 2) were conditioned and tested.

TABLE 2

| Sample | Center layer (web wt %) | Outer Layers (web wt %) | Furnish WRV (g/g) | GMT (g/3") | GM Slope (g) | Stiffness Index | Sheet Bulk (cc/g) |
|---|---|---|---|---|---|---|---|
| Control 2 | NSWK (30%) | EHWK (70%) | 1.54 | 729 | 11748 | 16.11 | 6.79 |
| Inventive 2 | NSWK (30%) | EHWK (14%), XL-EHWK (56%) | 1.29 | 704 | 9349 | 13.28 | 8.00 |

While tissue webs, and tissue products comprising the same, have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the foregoing embodiments:

In a first embodiment the present invention provides a method of manufacturing a cross-linked fiber comprising the steps of: (a) treating a plurality of fibers with a caustic solution at a temperature less than about 60° C. to yield a plurality of caustic extracted fibers having a hemicellulose content at least about 50 percent less than the plurality of fibers (b) mixing the caustic extracted fibers with a cross-linking agent to yield a plurality of treated fibers, and (c) drying the treated fibers at a drying temperature less than about 200° C.

In a second embodiment the present invention provides the method of the first embodiment wherein the fiber is *eucalyptus* hardwood kraft pulp and the hemicellulose content of the *eucalyptus* hardwood kraft pulp after treatment with caustic is less than about 5.0 percent.

In a third embodiment the present invention provides the method of the first or second embodiments wherein the caustic solution comprises a caustic agent selected from the group consisting of sodium hydroxide, potassium hydroxide and ammonium hydroxide, and combinations thereof, and the fiber consistency is from about 2.0 to about 25 percent.

In a fourth embodiment the present invention provides the method of any one of the first through third embodiments wherein the cross-linking agent is selected from the group consisting of polyamide-epichlorohydrin (PAE) resins, polyamide-polyamine-epichlorohydrin (PPE) resins, and polydiallylamine-epichlorohydrin resins.

In a fifth embodiment the present invention provides the method of any one of the first through fourth embodiments wherein the step of treating fiber with a cross-linking agent is carried out at a fiber consistency of less than about 10 percent.

In a sixth embodiment the present invention provides the method of any one of the first through fifth embodiments wherein the treating fiber with a cross-linking agent is carried out at a fiber consistency of less than about 5.0 percent, a pH from 6.0 to about 8.0 and a temperature less than about 40° C.

In a seventh embodiment the present invention provides the method of any one of the first through sixth embodiments wherein the amount of cross-linking agent is a PAE resin and the amount of PAE resin mixed with the caustic extracted fiber is from about 5 to about 20 kg per metric ton of fiber.

In an eighth embodiment the present invention provides the method of any one of the first through seventh embodiments wherein the drying step is carried out at a drying temperature from about 100 to about 160° C.

In a ninth embodiment the present invention provides a cross-linked fiber comprising a cellulosic fiber comprising less than about 5.0 percent hemicellulose, a cross-linking agent selected from the group consisting of polyamide-epichlorohydrin (PAE) resins, polyamide-polyamine-epichlorohydrin (PPE) resins, and polydiallylamine-epichlorohydrin resins, wherein the cross-linked fiber is dispersible in water and has a water retention value (WRV) less than about 0.80 g/g. The foregoing fiber may be dispersed in water and wet-laid into a sheet having less than about 15 percent knits per gram of sheet material and in certain embodiments the sheet material may have a sheet bulk greater than about 5.0 cc/g.

In a tenth embodiment the present invention provides a tissue web comprising at least about 10 percent, by weight of the web, cross-linked fiber, the web having a basis weight from about 20 to about 50 gsm and a sheet bulk of about 5 cc/g or greater.

In an eleventh embodiment the present invention provides the tissue web of the tenth embodiment wherein the cross-linked fiber comprises *eucalyptus* hardwood kraft fibers having a hemicellulose content less than about 5.0 percent and are cross-linked with a PAE resin.

In an twelfth embodiment the present invention provides the tissue web of the eleventh embodiment wherein the cross-linked fiber has a WRV less than about 0.80 g/g.

In an thirteenth embodiment the present invention provides the tissue web of the eleventh or twelfth embodiments comprising cross-linked cellulosic fibers, such as from about 5 to about 75 percent, and more preferably from about 20 to about 60 percent and still more preferably from about 20 to about 50 percent, cross-linked cellulosic fibers by weight of the product, where the sheet bulk of the product is at least about 10 percent greater than the sheet bulk of comparable tissue product, such as a tissue product having substantially equal strength and basis weight, that is substantially free from cross-linked fibers.

In a fourteenth embodiment the present invention provides the tissue web of the eleventh through thirteenth embodiments wherein the web is converted into a tissue product having a basis weight from about 20 to about 50 gsm, a GMT greater than about 600 g/3", a sheet bulk greater than about 7.0 cc/g and Stiffness Index less than about 15.

In a fifteenth embodiment the present invention provides the tissue web of the eleventh through fourteenth embodiments wherein the web is converted into a single-ply through-air dried tissue product comprising from about 5 to about 75 percent, and more preferably from about 20 to about 60 percent and still more preferably from about 20 to about 50 percent, by weight of the weight of the tissue product, cross-linked fibers, wherein the product has a basis weight from about 20 to about 50 gsm, a GMT from about 600 to about 1,000 g/3", a sheet bulk greater than about 10 cc/g, such as from about 10 to about 25 cc/g, and a Stiffness Index less than about 15.

In sixteenth embodiment the present invention provides a tissue product comprising a through-air dried tissue web comprising at least about 10 percent, by weight of the web, water dispersible cellulosic cross-linked fiber prepared according to the present invention, the tissue product having a basis weight from about 20 to about 50 gsm, a GMT greater than about 600 g/3" and a sheet bulk greater than about 7.0 cc/g.

In a seventeenth embodiment the present invention provides the tissue product of the sixteenth embodiment having a GMT from about 600 to about 1200 g/3" and Stiffness Index less than about 15.

In an eighteenth embodiment the present invention provides the tissue product of the sixteenth or seventeenth embodiment having a TS750 from about 40 to about 50.

In a nineteenth embodiment the present invention provides the tissue product of anyone of the sixteenth through eighteenth embodiments wherein the web is a multi-layered web comprising a first and second layer and the water dispersible cellulosic cross-linked fiber is selectively disposed in the second layer.

What is claimed is:

1. A method of manufacturing a cross-linked fiber comprising the steps of: (a) providing a plurality of fibers having a first hemicellulose content, (b) treating a plurality of fibers with a caustic solution at a temperature less than about 60° C. to yield a plurality of caustic extracted fibers having a second hemicellulose content which is at least about 50 percent less than the first hemicellulose content (c) mixing the caustic extracted fibers at a consistency of less than about 15 percent with a cross-linking agent selected from the group consisting of polyamide-epichlorohydrin (PAE) resins, polyamide-polyamine-epichlorohydrin (PPE) resins, and polydiallylamine-epichlorohydrin resins to yield a plurality of treated fibers, and (d) drying the treated fibers at a drying temperature less than about 200160° C. to yield a plurality of cross-linked fibers having a water retention value (WRV) less than about 0.80 g/g.

2. The method of claim 1 wherein the plurality of fibers are eucalyptus hardwood kraft pulp fibers and the second hemicellulose content is less than about 5.0 percent by weight of the fiber.

3. The method of claim 1 further comprising the step of dispersing the fibers in water to form a fiber slurry having a fiber consistency from about 2.0 to about 25 percent prior to the step of treating the plurality of fibers and wherein the caustic solution comprises a caustic agent selected from the group consisting of sodium hydroxide, potassium hydroxide and ammonium hydroxide, and combinations thereof.

4. The method of claim 1 wherein the cross-linking agent is a polyamide-epichlorohydrin (PAE) resin.

5. The method of claim 1 wherein the mixing step (c) is carried out at a consistency less than about 10 percent.

6. The method of claim 1 wherein the step of mixing the caustic extracted fibers with a cross-linking agent is carried out at a fiber consistency of less than about 5.0 percent, a pH from 6.0 to about 8.0 and a temperature less than about 40° C.

7. The method of claim 1 wherein the cross-linking agent is a PAE resin and the amount of PAE resin mixed with the caustic extracted fiber is from about 5 to about 20 kg per metric ton of caustic extracted fiber.

8. The method of claim 1 wherein the drying step is carried out at a drying temperature from about 100 to about 160° C.

9. A fibrous sheet comprising water dispersible cellulosic cross-linked fiber comprising less than about 5.0 percent hemicellulose, a cross-linking agent selected from the group consisting of polyamide-epichlorohydrin (PAE) resins, polyamide-polyamine-epichlorohydrin (PPE) resins, and polydiallylamine-epichlorohydrin resins, wherein the water dispersible cellulosic cross-linked fiber has a water retention value (WRV) less than about 0.80 g/g, and the fibrous sheet has less than 15 percent knits per gram of sheet material.

10. The fibrous sheet of claim 9 wherein the sheet having has less than about 12 percent knits per gram of sheet material.

11. The fibrous sheet of claim 10 having a sheet bulk greater than about 5.0 cc/g.

12. A tissue web comprising at least about 10 percent, by weight of the web, the fibrous sheet of claim 9, the web having a basis weight from about 20 to about 50 gsm and a sheet bulk of about 5.0 cc/g or greater.

13. The tissue web of claim 12 wherein the cellulosic fibers are eucalyptus hardwood kraft pulp fibers and the cross-linking agent is a PAE resin.

14. The tissue web of claim 12 wherein the web comprises from about 25 to about 45 weight percent water dispersible cellulosic cross-linked fiber.

15. A method of making a high bulk tissue product comprising the steps of: (a) dispersing cross-linked fibers comprising less than about 5.0 percent hemicellulose and a cross-linking agent selected from the group consisting of polyamide-epichlorohydrin (PAE) resins, polyamide-polyamine-epichlorohydrin (PPE) resins, and polydiallylamine-epichlorohydrin resins in water to form an aqueous suspension of cross-linked fibers having a WRV less than about 0.80 g/g; (b) depositing the aqueous suspension of cross-linked fibers on a forming fabric to form a wet tissue web (c) partially dewatering the wet tissue web and (d) drying the partially dewatered tissue web to a consistency of at least about 95 percent to form a dry tissue web; and (e) converting the tissue web to form a tissue product, wherein the tissue product has a basis weight from about 10 to about 50 gsm and a sheet bulk of about 5 cc/g or greater.

16. The method of claim 15 wherein the drying step comprises non-compressively drying the tissue web.

17. The method of claim 15 wherein the drying step comprises transferring the partially dewatered web to a Yankee dryer and further comprising the step of creping the dried web to remove the web from the Yankee dryer surface.

18. The method of claim 15 wherein the cross-linked fibers are not fiberized prior to the dispersing step (a).

19. The method of claim 15 wherein the tissue web has less than about 15 percent knits per gram of web.

20. The method of claim 15 further comprising the steps of dispersing papermaking fibers that have not been subjected to cross-linking in water to form a second aqueous fiber suspension and depositing the second aqueous suspension on a forming fabric along with an aqueous suspension of cross-linked fibers to form a wet tissue web.

* * * * *